United States Patent [19]

Naus et al.

[11] 3,960,428

[45] June 1, 1976

[54] ELECTRICAL CONNECTOR

[75] Inventors: Hubert W. Naus, Monrovia; John L. Hawkins, Jr., Pasadena, both of Calif.

[73] Assignee: International Telephone and Telegraph Corporation, New York, N.Y.

[22] Filed: Apr. 7, 1975

[21] Appl. No.: 565,344

[52] U.S. Cl. ..... 339/90 R; 116/114 R; 339/113 L; 339/DIG. 2

[51] Int. Cl.[2] ..... H01R 13/54

[58] Field of Search ..... 339/89–91, 339/113, DIG. 2; 285/86, 93; 116/114 R

[56] References Cited

UNITED STATES PATENTS

| | | | |
|---|---|---|---|
| 2,631,185 | 3/1953 | Earle et al. | 339/91 B |
| 2,892,991 | 6/1959 | Beebee et al. | 339/91 B |
| 3,008,116 | 11/1961 | Blanchenot | 339/91 B |
| 3,191,972 | 6/1965 | Collar | 285/93 |
| 3,196,424 | 7/1965 | Hardesty et al. | 339/113 L |
| 3,343,852 | 9/1967 | Blight et al. | 339/DIG. 2 |
| 3,569,908 | 3/1971 | Appleton | 339/111 |
| 3,587,032 | 6/1971 | Normann | 339/89 M |

*Primary Examiner*—Roy Lake
*Assistant Examiner*—Neil Abrams
*Attorney, Agent, or Firm*—Thomas L. Peterson

[57] ABSTRACT

An electrical connector having means providing a signal when the connector members are fully engaged. The coupling nut on one connector member carries a detent pin which engages a mating recess in the shell of the connector member when the member is fully coupled to its mating connector member. When the detent pin engages the recess, an electrical indicator circuit is closed providing a signal that the connector members are mated. A releasable lock ring is also provided on the coupling nut which maintains the detent pin engaged with the recess.

9 Claims, 5 Drawing Figures

ELECTRICAL CONNECTOR

BACKGROUND OF THE INVENTION

This invention relates generally to an electrical connector and, more particularly, to an electrical connector embodying means for indicating when the two connector members of the connector are fully mated together.

An electrical connector comprises plug and receptacle connector members each including a shell containing an insulator. A plurality of pairs of axially aligned contacts are mounted in the respective insulators in the two connector members. In many applications, it is necessary to provide an interfacial seal on one of the insulators to assure that a complete sealing condition is established for each mated pair of contacts when the two connector members are interengaged. Also, typically a peripheral seal is provided in one of the connector shells engageable by the shell of the other connector member to prevent the intrusion of dust or moisture into the interior of the connector. Also, a coupling nut is mounted on the plug connector member for interengaging the two members, bringing the contacts of each pair of contacts into electrically coupled condition, and establishing the interfacial and peripheral sealing conditions in the connector. Generally, the contacts in the connector members are removably mounted therein so that they may be replaced in the field. Becuase of the use of such a contact mounting arrangement, and the large number of parts in an electrical connector, there is a large buildup of manufacturing tolerances which must be maintained to insure that all contacts are fully electrically coupled together, that the interfacial and peripheral seals are established, and that the coupling nut is in its fully coupled position. When manufacturing tolerances are not met, there is generally no way of determining whether or not all the aforementioned conditions have been established when two electrical connector members are coupled together. This may become a considerable problem in electronic systems utilizing a large number of connectors since there is no way of determining which connector in the system is not fully operational if the system fails. Furthermore, it is often desirable to know in advance whether all the connectors are functional. It is the object of the present invention to provide an electrical connector which incorporates electrical means for giving a signal when the connector is fully coupled together, thus enabling the operator to determine which line in the electronic system is not operable. Another object of the invention is to provide an electrical connector which produces either an audio or tactile indication, or both, of the full mating of the connector members so that the mated condition can be determined by the operator even in blind mating situations, that is, where the operator cannot visually observe whether the connector members are fully interengaged.

SUMMARY OF THE INVENTION

According to the principal aspect of the present invention, there is provided an electrical connector in which one of the connector members has a coupling nut thereon to effect interengagement of the two members. When the coupling nut fully engages the two connector members, the contacts are fully mated and the peripheral and interfacial seals are established. Detent means is carried on the coupling nut which is releasably engaged with the shell on which the coupling nut is mounted. Releasable means locks the detent means into engagement with the shell when the connector members are mated. When the detent means lockingly engages the shell, a clicking noise results providing an audio indication of the fully mated condition of the connector. In the preferred embodiment, when the detent means is so engaged, an electrical circuit is closed energizing a signalling device providing an additional indication that the connector members are fully mated. The fully mated condition may also be noted by free rotation of the lock means on the coupling nut. Thus, the invention provides redundant signalling means for indicating the full engagement of an electrical connector.

DESCRIPTION OF THE PREFERRED EMBODIMENT

Figure 1:
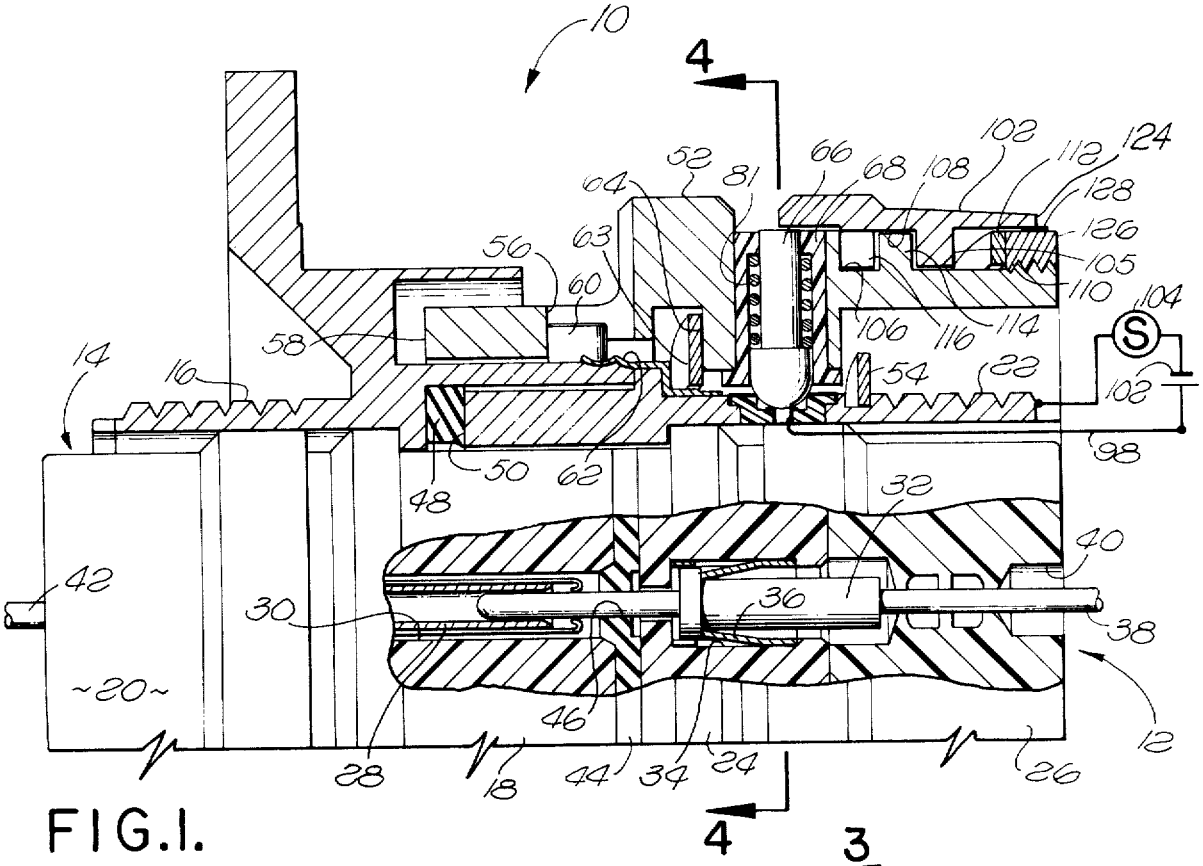
FIG. 1 is a partial longitudinal sectional view of the connector of the present invention, showing the receptacle connector member and plug connector member fully mated together.

Referring now to the drawings in detail, there is illustrated the connector of the present invention, generally designated 10, which includes a plug connector member 12 and a receptacle connector member 14. The receptacle connector member 14 comprises a shell 16 containing a rigid insulator 18 and wire sealing grommet 20 behind the insulator. The insulator 18 is preferably molded of a reinforced epoxy thermoset material. The grommet 20 is preferably molded of high strength silicone base elastomer. The plug connector member 12 also comprises a shell 26 containing an insulator 24 and a rear wire sealing grommet 26.

The receptacle connector member 14 contains a plurality of socket contacts 28, only one being illustrated, each mounted in a longitudinally extending bore 30 in the insulator 18. The plug connector member 12 contains a plurality of pin contacts 32, only one being shown, each mounted in a bore 34 axially aligned with a bore 30 and adapted to be electrically coupled with the socket contact 28 when the connector members are fully mated. The pin contacts 32 are removably mounted within the bores 34 by contact retention clips 36. The socket contacts 28 are mounted in the bores 30 in a similar fashion. The pin contacts 32 are connected to the ends of insulated wires 38 that pass through passages 40 in the rubber grommet 26. The socket contacts 28 in the receptacle connector member terminate insulated wires 42 which extend rearwardly through passages, not shown, in the grommet 26 aligned with the bores 30. Only one each of the wires 38 and 42 are shown in the drawings.

An interfacial seal 44, preferably formed of a silicone-base elastomer, is bonded to the front face of the insulator 24. The seal contains openings 46 through which the pin contacts extend. The shell 16 of the receptacle connector member 14 contains a peripheral seal 48 which is engaged by the end 50 of the shell 22 when the two connector members are fully mated. A coupling nut or ring 52 is rotatably mounted on the shell 22. The nut 52 is limited against rearward axial movement relative to the shell by a snap ring 54. The coupling nut is formed with a helical shaped coupling nut ramp or slot 55 which opens at the front edge 58 of the nut, and cooperates with a pin 60 fixed to the shell 16 on the receptacle connector member providing a bayonet-type coupling arrangement as is well known in the art. Upon rotation of thhe coupling nut 52 in the clockwise direction, the nut draws the two shells 16 and 22 toward each other, effecting interengagement of the two connector members and electrical coupling of the contacts 28 and 32. When the connector members are fully interengaged, the end 50 of the shell 22 deforms the seal 48, establishing a peripheral sealing condition between the two connector members, and the interfacial seal 44 is compressed, providing a seal for each of the pin contacts. Preferably a metal grounding spring 62 is mounted on the shell 22 which electrically engages the shell 16 when the connector members are mated together. A wave spring 63 is disposed between the ground spring 62 and a forwardly facing shoulder 64 on the coupling nut, urging the nut rearwardly against the retaining ring 54 as seen in FIG. 2 when the plug connector member is uncoupled from the receptacle connector member.

The parts of the connector 10 described so far are generally conventional and constitute no part of the present invention. As explained previously herein, at the present time there is generally no way that the user can determine that an open circuit in an electrical system with which he is concerned exists in a connector, or in a particular connector out of a large number of connectors. The purpose of the present invention is to provide means for indicating when an electrical connector is fully mated, so that unmated connectors can be ascertained.

In accordance with the invention, a detent arrangement is provided which does not become fully seated until the connector members completely engage, providing electrical continuity through the connector, and fully establishing the peripheral seal and interfacial seal within the connector. Such detent arrangement comprises a plurality of metal detent pins 66, three being shown by way of example only in FIG. 4. The pins are slidably mounted in hat-shaped plastic cups 68 fixed in radially extending bores 70 in the coupling nut 52. The rim 72 of each cup 68 engages the inner surface 74 of the nut. A central bore 76 is provided in the outer end of the cup 68. The outer end of the pin 66 is slidable in the bore 76. The inner end 78 of each pin is enlarged to provide an outwardly facing annular shoulder 80. The inner end 78 has a semi-hemispherical configuration. A coil compression spring 81 extends from the upper end of the cup 68 to the shoulder 80 to bias the pin radially inwardly toward the shell 22.

Figure 2:
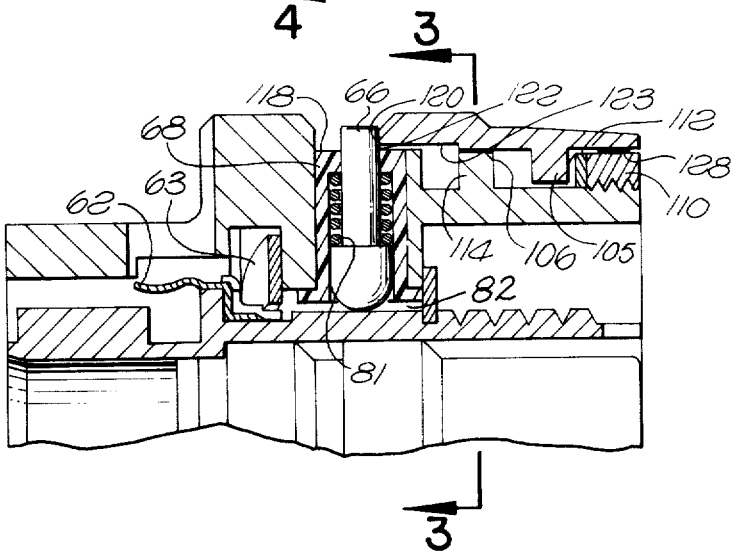
FIG. 2 is a partial longitudinal sectional view through the plug connector member of the present invention, when it is disengaged from the receptacle connector member.
Figure 5:
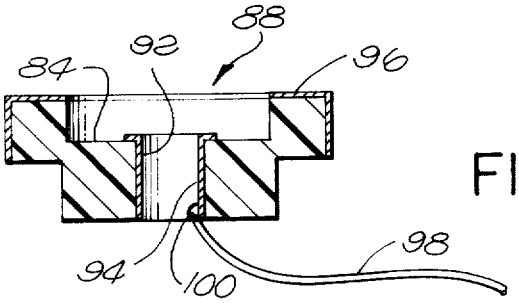
FIG. 5 is an enlarged sectional view through a conductor coated disc forming a part of the electrical signal means of the invention.
Figure 4:
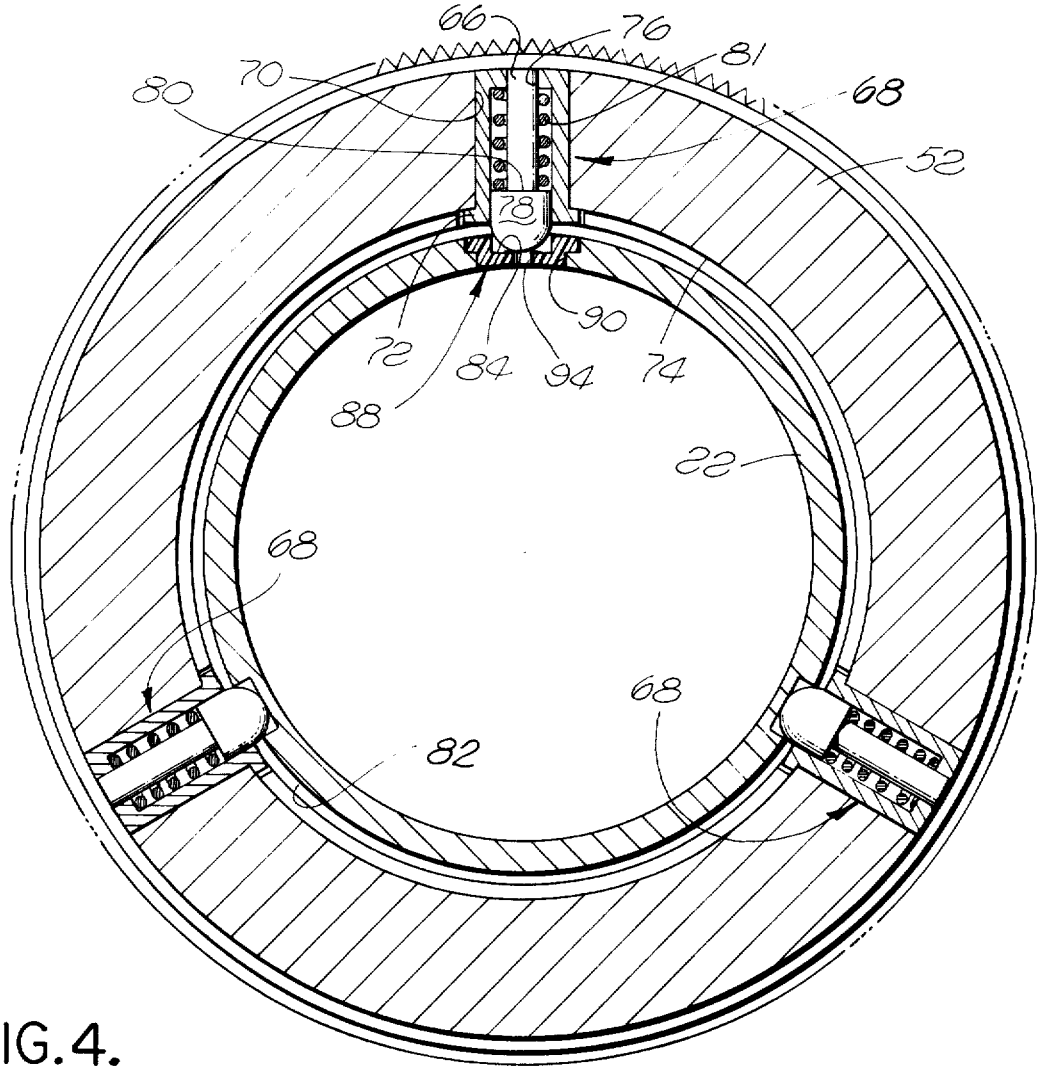
FIG. 4 is a transverse sectional view taken along line 4—4 of FIG. 1.

As seen in FIG. 2, when the connector members are disengaged, the inner ends 78 of the pins 66 about a smooth cylindrical outer surface area 82 of the shell 22. However, when the connector members 12, 14 are fully mated by the coupling nut 52, as illustrated in FIG. 1, the pins drop into corresponding recesses 84 formed in the outer surface of the shell 22. As seen in FIG. 4, the three detent pins 66 are disposed 120° apart. The recesses 84 likewise are spaced 120° apart and are aligned with the pins when the coupling nut 52 is in its fully coupled position, as seen in FIG. 1. The pins and mating recesses could have other angular spacing if desired. When the coupling nut is in its unmated position as illustrated in FIG. 2, the detent pins 66 are angularly displaced relative to the recesses 84 and spaced axially behind the recesses. Typically, the coupling nut is rotated about 105° to effect full mating of the two electrical connector members. Thus, the recesses 84 are angularly offset from the pins 66 approximately 105° when the coupling nut is in its unmated position shown in FIG. 2.

As seen in the lower half of FIG. 4, the recesses 84 for the two lower pins in the plug connector member 12 are formed directly in the outer surface 82 of the shell 22. The recess 84 for the upper detent pin illustrated in FIG. 4 is provided by a disc 88 which is mounted in an opening 90 in the shell 22. The disc 88 is formed of insulative material. A hole 92 extends through the center of the disc. The hole is plated with a conductive material as indicated at 94. The upper surface and outer periphery of the disc 18 are also coated with a conductive layer 96. Thus the conductive layers 94 and 96 are electrically isolated from each other. A wire 98 is soldered to the plated-through hole 94 as indicated at 100. This wire lies along the outer surface of the insulator 24 and grommet 26, leading to an electrical signalling circuit including a power source 102, a signal indicator 104 and the shell 22. The indicator is preferably a light. When the pin 66 shown at the top of FIG. 4 is seated in the recess 84, it engages the conductive layers 94, 96. Since the pin is formed of metal, it electrically interconnects such layers, thereby closing the circuit including the light 104, so that the light is energized. The light indicates that the detent pins 66 have all fallen into their respective recesses 84 which occurs only after the coupling nut is in its final position, thereby indicating the full mating interengagement of the two connector members 12 and 14. The light may be positioned at any distance from the connector 10, and thereby provides a remote indication as to whether or not the connector members 12 and 14 are fully mated.

Figure 3:
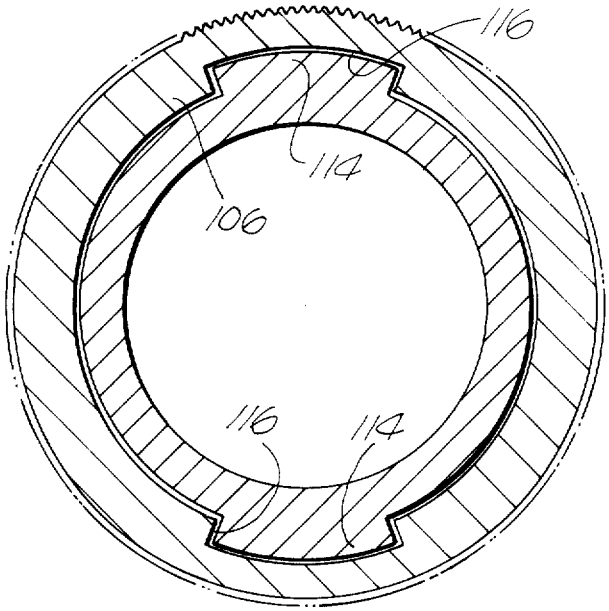
FIG. 3 is a transverse sectional view taken along the line 3—3 of FIG. 2.

It will be appreciated that when the coupling nut is moved from the position illustrated in FIG. 2 to that illustrated in FIG. 3 to fully mate the connector members 12 and 14, the detent pins 66 will snap into their respective recesses 84 under the force of the springs 81, producing a clicking noise which provides an audio signal of the fully mated condition of the connector members.

A slide lock ring 102 surrounds the rear portion of the coupling nut 52. This ring is formed with a pair of axially spaced inwardly extending annular flanges 105 and 106 defining an annular groove 108 therebetween. A retaining ring 110 is threaded onto the rear portion of the coupling nut. A wave spring 112 is disposed between the ring 110 and the flange 105 biasing the lock ring in the forward direction. The coupling nut is formed with a pair of outwardly extending diametrically opposed tongues or lugs 114 which engage into complementary grooves 116 formed in the flange 106. As seen in FIG. 2, each detent pin 66 is sufficiently long so that when its inner end engages the cylindrical surface 82 of the shell 22, the outer end of the pin extends beyond the outer surface 118 of the cup 68. The lock ring 110 is positioned so that its forward edge 120 abuts the sides 122 of the pins 66 so that the pins retain the lock ring in a rearward position on the coupling nut. In this position of the lock ring, the grooves 116 therein receive the tongues 114 on the coupling nut so that the lock ring cannot rotate relative to the coupling nut. When the user rotates the coupling nut 52 to mate the connector members 12 and 14, the lock ring 102 will rotate with the coupling nut until the detent pins 66 register with the recesses 84, wherein the pins will spring inwardly to engage the recesses, as seen in FIG. 1, removing the outer ends of the pins away from the front edge 120 of the locking ring so that the ring may shift forwardly under the force of the spring 112. As a consequence, the tongues 114 and grooves 116 will disengage. The tongues 114 will become disposed within the annular groove 108 in the lock ring so that the lock ring will freely rotate on the coupling nut. The inner surface 123 of the lock ring adjacent to the forward edge 120 thereof extends over the outer ends of the detent pins after the pins engage the recesses 84, as seen in FIG. 1, preventing the pins from moving outwardly and thereby locking the pins in the recesses so that the pins cannot release therefrom. In this condition, the coupling nut cannot be rotated to separate the plug and receptacle connector members.

Preferably, the lock ring 102 is dimensioned so that its rear end 124 is spaced from the rear 126 of the retaining ring 110 when the lock ring is in its forward position as illustrated in FIG. 1. A colored stripe 128 is provided on the outer surface of the retaining ring 110. This stripe, which may be a bright color such as red or orange, is exposed when the lock ring is in its forwrd position, thereby providing a visual indication that the connector members are fully engaged.

In summary, the connector members 12 and 14 are positioned so that the bayonet pin 60 engages into the coupling nut ramp 56 of the coupling nut. The coupling nut and lock ring 102 are rotated in a clockwise direction causing the bayonet pin to slide along the helical ramp of the coupling nut, thereby driving the plug shell 22 into the receptacle connector member shell 16 to mate the two connector members. When the bayonet pin reaches the end of the helical ramp, the contacts 28 and 32 are engaged, interfacial and peripheral sealing is achieved and the grounding spring 62 is engaged with the shell 16. When the mating sequence is completed, the three detent pins 66 snap into the recesses 84, providing an audio indication of the fully mated condition of the connector, and also energizing the remote indicator device 104. When the detent pins snap into the recesses, the lock ring 102 slides forwardly, disengaging the grooves 116 and lugs 114, thereby allowing the ring to rotate freely. The free rotation of the lock ring on the coupling nut provides a tactile indication that the connector members are fully mated, so that the fully mated condition can be determined by the operator at the site of the connector even in a blind mating situation. Also, when the foregoing sequence is completed, the movement of the lock ring forwardly on the coupling nut exposes the colored strip 128 on the retaining ring 110 providing a visual indication that the connector is mated.

After the connector has become fully mated, it cannot be unmated until the slide lock ring is positioned to align the grooves 116 therein with the tongues 114. A slight steady pull rearward on the lock ring causes the detents pins 66 to be cammed outwardly out of the recesses 84 permitting the coupling nut to be rotated counterclockwise to unmate the connector. Thus, it is seen that by the present invention there is provided an arrangement for producing tactile, electrical, visual and audio indications of the fully mated condition of an electrical connector.

What is claimed is:

1. An electrical connector comprising:

mating receptacle and plug connector members, each said connector member comprising a shell containing an insulator;

a plurality of pairs of axially aligned contacts mounted in said insulators, respectively, the axially aligned contacts of each pair being in an electrically coupled condition when said connector members are mated;

a rotatable coupling ring on one of said shells engageable with the other shell for mating said connector members;

at least one detent pin slidably mounted in a radially extending bore in said coupling ring;

a recess in the outer surface of said one shell aligned with said pin when said connector members are mated;

means biasing said pin radially inwardly in said bore to engage said recess;

releasable means positively locking said detent pin into engagement with said recess when said connector members are mated;

said releasable locking means comprising a lock ring surrounding said coupling ring, means mounting said lock ring on said coupling ring for axial movement thereon between first and second positions, said lock ring having an inner surface adjacent to said pin dimensioned to extend over the outer end of said pin when said pin engages said recess, in said first position of said lock ring said inner surface being located at one side of said pin, in said second position of said lock ring said inner surface extending over said outer end of said pin to lock said pin in said recess, means biasing said lock ring from said first position toward said second position, and said mounting means preventing rotation between said lock ring and said coupling ring when said lock ring is in said first position and allowing rotation between said lock ring and said coupling ring when said lock ring is in said second position.

2. An electrical connector as set forth in claim 1 including: electrical signal means associated with said detent pin and recess for providing a signal when said connector members are mated.

3. An electrical connector as set forth in claim 1 wherein: said mounting means includes engaging tongue and groove means on said lock ring and coupling ring preventing relative rotation therebetween when said lock ring is in said first position.

4. An electrical connector as set forth in claim 3 wherein:

said tongue and groove means are disengaged in said second position of said lock ring.

5. An electrical connector as set forth in claim 1 including:

visual indicating means on said coupling ring for indicating when said connector members are mated.

6. An electrical connector as set forth in claim 5 wherein:

said lock ring covers said visual indicating means when in said first position and exposes said visual indicating means when in said second position.

7. An electrical connector as set forth in claim 1 including:

an insulator member on said one shell forming said recess;

at least the inner end of said detent pin being formed of an electrical conductor;

electrical signal means for providing a signal when said connector members are mated; and said signal means comprising an electrical circuit including a pair of spaced conductors on said insulator member arranged to be bridged by said inner end of said detent pin when said pin engages said recess.

8. An electrical connector comprising:

mating receptacle and plug connector members, each said connector member comprising a shell containing an insulator;

a plurality of pairs of axially aligned contacts mounted in said insulators, respectively, the axially aligned contacts of each pair being in an electrically coupled condition when said connector members are mated;

a rotatable coupling ring on one of said shells engageable with the other shell for mating said connector members;

detent means carried by said coupling ring means being releasably engaged with a detent receiving recess on said one shell when said connector members are mated;

releasable means locking said detent means into engagement with said detent receiving recess when said connector members are mated; and electrical signal means associated with said detent means for providing a signal when said connector members are mated, said electrical signal means comprising an electrical circuit including said detent means and said detent receiving recess but excluding said contacts.

9. An electrical connector as set forth in claim 8 including:

an insulator member on said one shell forming said detent receiving recess;

said detent means comprises a detent pin slidably mounted in a radially extending bore in said coupling ring;

at least the inner end of said detent pin being formed of an electrical conductor; and said electrical circuit means including a pair of spaced conductors on said insulator member arranged to be bridged by said inner end of said detent pin when said pin engages said recess.

* * * * *